US007802615B2

(12) United States Patent
Martinus et al.

(10) Patent No.: US 7,802,615 B2
(45) Date of Patent: Sep. 28, 2010

(54) SOUND ATTENUATING SHIELD FOR AN ELECTRIC HEATER

(75) Inventors: Ferdy Martinus, Onalaska, WI (US); William B. Rockwood, Onalaska, WI (US)

(73) Assignee: Trane International Inc., Piscataway, NJ (US)

( * ) Notice: Subject to any disclaimer, the term of this patent is extended or adjusted under 35 U.S.C. 154(b) by 1056 days.

(21) Appl. No.: 11/356,283

(22) Filed: Feb. 16, 2006

(65) Prior Publication Data

US 2007/0187076 A1 Aug. 16, 2007

(51) Int. Cl.
*F25B 29/00* (2006.01)

(52) U.S. Cl. ..... 165/64; 165/122; 165/135; 392/377

(58) Field of Classification Search ..... 165/41, 165/42, 43, 44, 51, 63, 64, 122, 135; 62/167, 62/180, 262, 275, 281; 181/198, 200, 202, 181/205, 207, 224, 229; 219/338; 392/377
See application file for complete search history.

(56) References Cited

U.S. PATENT DOCUMENTS 1,745,492 A * 2/1930 Kelch et al. ..... 165/51
1,752,038 A * 3/1930 Sunday ..... 165/51
2,160,269 A * 5/1939 Jorolemon ..... 165/64
2,160,666 A 5/1939 McMahan
2,171,341 A 8/1939 McMahan
2,708,546 A 5/1955 Caldwell
3,178,161 A 4/1965 Yeo et al.
3,346,174 A 10/1967 Lievens et al.
4,361,525 A 11/1982 Leyland
4,637,223 A 1/1987 Hosoya et al.
5,341,650 A * 8/1994 Nagasawa et al. ..... 62/180
5,868,551 A 2/1999 Smiley, III et al.
6,039,532 A 3/2000 McConnell
6,345,688 B1 2/2002 Veen et al.
6,658,882 B2 * 12/2003 Ohama et al. ..... 62/262
6,692,223 B2 * 2/2004 Ikeda et al. ..... 165/122
6,935,835 B2 8/2005 Della Mora
7,431,127 B2 * 10/2008 de Borchgrave et al. .... 181/229

* cited by examiner

*Primary Examiner*—Ljiljana (Lil) V Ciric
(74) *Attorney, Agent, or Firm*—William O'Driscoll

(57) ABSTRACT

A sound-abating flow disruptor quiets a PTAC refrigerant system by disturbing the airflow between an energized electric heater and an adjacent fan wheel. In some embodiments, the flow disruptor is a perforated metal plate that attenuates a whistle, which appears to be caused by vortex shedding in the confined area between the energized heater and the fan. In some cases, the heater comprises selectively energizable heating elements of various wattage. The heating elements closest to the fan wheel are the lower wattage ones to minimize the heat near the fan.

26 Claims, 4 Drawing Sheets

SOUND ATTENUATING SHIELD FOR AN ELECTRIC HEATER

BACKGROUND OF THE INVENTION

1. Field of the Invention

The subject invention generally pertains to PTAC refrigerant systems that include an electric heater and a blower. The invention more specifically pertains to a way of attenuating the whistle that tends to emanate from an area near the electric heater.

2. Description of Related Art

Packaged Terminal Air Conditioners/Heat Pumps or PTACs, as they are known in the HVAC industry, are self-contained refrigerant systems with an electric heater for selective heating and cooling modes. Although PTACs are often used for cooling and heating hotel rooms, they are also used in a wide variety of other commercial and residential applications such as apartments, hospitals, nursing homes, schools, and government buildings. PTACs are usually installed in an opening of a building's outer wall, so an exterior-facing refrigerant coil can exchange heat with the outside air. In some cases, the refrigerant side of the system is a heat pump that not only provides cooling, but also provides heat during milder conditions or contributes heat when the electric heater is operating.

Because PTACs protrude into the living space of a room, they need to be as compact and quiet as possible. The electric heater, refrigerant circuit, fans, and other components of the system are all tightly packaged within a minimally sized housing. This presents a number of challenging problems, particularly with the electric heater.

The heater, of course, can get quite hot, so it needs to be safely spaced apart from the exterior walls of the PTAC's housing. To avoid wasting heat, the heater should also be isolated from the exterior-facing refrigerant coil, which is cold during the heating mode for absorbing heat from the outside air. Consequently, the electric heater is typically installed immediately upstream of the indoor fan, which circulates the room air and/or some ventilating outside air through the PTAC.

With the electric heater at this location, the current inventors have discovered that a "whistling" noise seems to emanate from the heater. Supporting the heating elements or other components more firmly or less firmly failed to eliminate the whistle. Since the noise disappears when the heater is de-energized (while the indoor fan is still running) the true source of the noise was a mystery. After closely studying the problem, however, the current inventors have discovered the true source of the noise and now propose a solution.

SUMMARY OF THE INVENTION

It is an object of the invention to reduce the tonal noise resulting from the proximity of an electric heater and a fan wheel.

Another object of some embodiments is to reduce the tonal noise by minimally disrupting the airflow between the electric heater and the fan wheel.

Another object of some embodiments is to reduce the tonal noise by positioning higher wattage heating elements farther away from the fan wheel.

Another object of some embodiments is to provide a flow obstruction at some heating elements that are spaced within one fan diameter of the fan wheel and leave other heating elements that are at least half of fan diameter away substantially unobstructed.

Another object of some embodiments is to reduce the height of an electric heater to where the heater is shorter than an adjacent refrigerant heat exchanger.

Another object of some embodiments is to horizontally stagger a plurality of heating elements to help reduce the tonal noise.

Another object of some embodiments is to provide a noise-abating flow obstructer with no moving parts.

Another object of some embodiments is to reduce the tonal noise at a certain peak frequency between 500 and 1,500 Hz.

Another object of some embodiments is to provide a noise-abating flow disruptor that is primarily open to minimize the obstruction of flow therethrough.

Another object of some embodiments is to selectively energize heating elements to avoid energizing, whenever possible, those elements that are closest to the fan wheel.

Another object of some embodiments is to selectively energize heating elements of various wattage to provide different levels of total heat output.

One or more of these and/or other objects of the invention are provided by a refrigerant system that includes a noise-abating flow disruptor interposed between an upper heating element and a fan wheel.

The present invention provides a refrigerant system. The system includes a housing, a refrigerant heat exchanger disposed within the housing and a fan wheel rotating about an axis and thereby forcing air through the housing. The system also includes an electric heater upstream of the fan wheel and downstream of the refrigerant heat exchanger wherein the electric heater can be selectively energized and de-energized. The system further includes a sound at a certain peak frequency between 500 and 1,500 hertz emanating from the refrigerant system, wherein the sound at one meter from the axis is no more than 5 decibels louder when the electric heater is energized than when the electric heater is de-energized.

The present invention also provides a refrigerant system including a housing defining an inlet and an outlet, a fan wheel disposed within the housing and being rotatable about an axis to force air through the housing, a refrigerant heat exchanger disposed within the housing and an electric heater disposed within the housing. The electric heater is downstream of the refrigerant heat exchanger and upstream of the fan wheel. The system also includes a noise-abating flow disruptor located downstream of the electric heater and upstream of the fan wheel such that the air passes sequentially through the electric heater, through the noise-abating flow disruptor and across the fan wheel. The noise-abating flow disruptor creates a sufficient airflow disruption such that the refrigerant system operates more quietly with the noise-abating flow disruptor than if the noise-abating flow disruptor were omitted.

The present invention further provides a refrigerant system including a housing, a fan wheel disposed within the housing and being rotatable about an axis for forcing air through the housing, a refrigerant heat exchanger disposed within the housing, an electric heater disposed within the housing and a noise-abating flow disruptor interposed between the electric heater and the fan wheel. Air passes sequentially through the electric heater, through the noise-abating flow disruptor and across the fan wheel. The noise-abating flow disruptor creates a sufficient airflow disruption such that the refrigerant system operates more quietly with the noise-abating flow disruptor than if the noise-abating flow disruptor were omitted. More specifically, at a certain peak sound frequency within 500 to 1,000 hertz, the noise-abating flow disruptor allows the refrigerant system to generate at least 5 decibels less noise at one meter from the axis than if the noise-abating flow disruptor were omitted.

The present invention still further provides a refrigerant system which includes a housing, a refrigerant heat exchanger disposed within the housing, an electric heater disposed within the housing and a fan wheel disposed within the housing for forcing air across the refrigerant heat exchanger and the electric heater. The electric heater has a plurality of selectively energizable heating elements including a higher-wattage element and a lower-wattage element, and the fan wheel is closer to lower-wattage element than the higher-wattage element.

The present invention additionally provides a refrigerant system which includes a housing, a refrigerant heat exchanger disposed within the housing, an electric heater disposed within the housing and a fan wheel disposed within the housing for forcing air through the refrigerant heat exchanger and the electric heater. The electric heater has a plurality of selectively energizable heating elements that are vertically distributed and staggered such that at least two of the plurality of the selectively energizable heating elements are displaced out of alignment with each other.

DESCRIPTION OF THE PREFERRED EMBODIMENT

Figure 1:
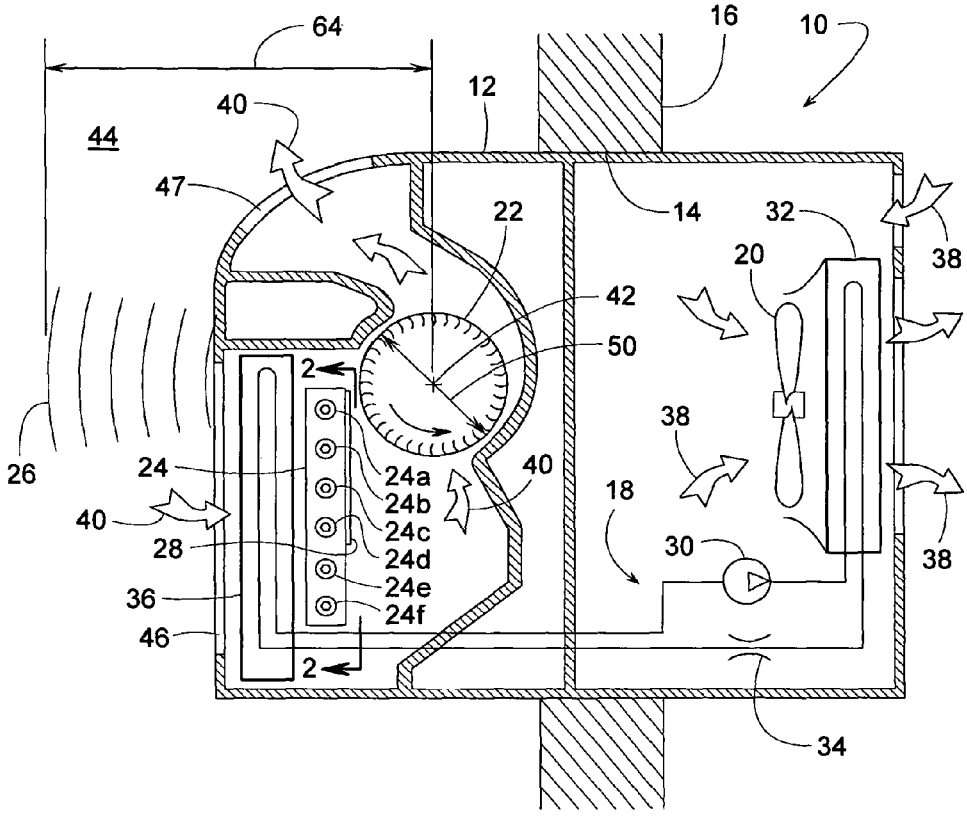
FIG. 1 is a schematically illustrated cross-sectional side view of a PTAC refrigerant system that includes a noise-abating flow disruptor.

Although PTACs come in various configurations, FIG. 1 illustrates an exemplary refrigeration system 10 that is particularly suited as a PTAC unit. System 10 includes an outer housing 12 that can be installed in an opening 14 of a building's exterior wall 16. In this example, housing 12 contains a refrigerant circuit 18, an outdoor fan 20, an indoor fan or centrifugal fan wheel 22, and an electric heater 24. To reduce or eliminate a "whistling" noise 26 emanating from an area near heater 24, a novel noise-abating flow disruptor 28 can be installed between heater 24 and fan wheel 22. Before describing details of flow disruptor 28, more general information about system 10 will be presented.

Refrigerant circuit 18 of system 10 comprises a compressor 30 for compressing refrigerant, an outdoor refrigerant heat exchanger 32, an expansion device 34 (e.g., thermal expansion valve, electronic expansion valve, orifice, capillary, etc.), and an indoor refrigerant heat exchanger 36. In a cooling mode, compressor 30 forces refrigerant sequentially through outdoor heat exchanger 32 functioning as a condenser to cool the refrigerant with outdoor air 38 moved by fan 20, through expansion device 34 to cool the refrigerant by expansion, and through indoor heat exchanger 36 functioning as an evaporator to absorb heat from indoor air 40 (and/or some outside air) moved by fan wheel 22.

If refrigerant circuit 18 is a heat pump operating in a heating mode, the refrigerant's direction of flow through heat exchanger 32, expansion device 34 and heat exchanger 36 is generally reversed so that indoor heat exchanger 36 then functions as a condenser to heat air 40, and outdoor heat exchanger 32 functions as an evaporator to absorb heat from outdoor air 38. If additional heat is needed or refrigerant circuit 18 is only operable in a cooling mode, heater 24 can be energized for heating air 40.

Figure 2:
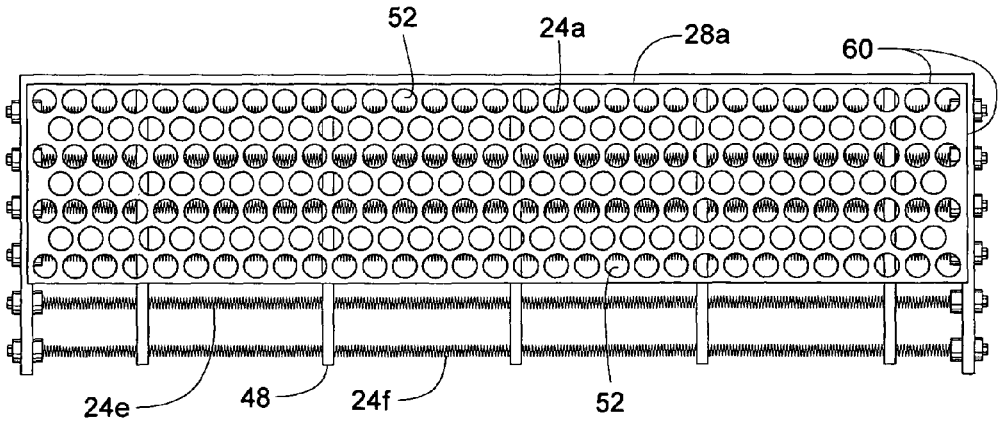
FIG. 2 is a front view of one embodiment of a noise-abating flow disruptor that can be used in the PTAC of FIG. 1.

When system 10 operates in a heating or cooling mode, a motor is energized to rotate fan wheel 22 about an axis 42. Fan wheel 22 draws air 40 from within a comfort zone 44 through an inlet 46 of housing 12. After air 40 enters housing 12, fan 22 forces air 40 to pass through heat exchanger 36 and heater 24. Fan 22 then discharges heated or cooled air 40 through an outlet 47 of housing 12 to return the air to comfort zone 44. For variable capacity, fan wheel 22 can be run at high or low speed to adjust the flow rate of air 40, and heater 24 may comprises a plurality of electric resistant heating elements 24*a*, 24*b*, 24*c*, 24*d*, 24*e* and 24*f* that can be selectively energized in different combinations to provide various kilowatts of heat energy. In a currently preferred embodiment, heating elements 24*a-f* are helical coils of electrically resistive wire that are supported by heat resistant electrical insulators 48 (FIG. 2). Electrically resistive heating elements and insulators 48 are well known to those of ordinary skill in the art.

Although the location of heater 24 provides a PTAC that is generally compact yet avoids creating dangerous hot spots within housing 12, noise 26 needs to be addressed. Noise 26 is a tonal sound whose maximum sound pressure level occurs at a certain peak frequency somewhere between 500 and 1,500 hertz. The actual peak frequency may vary depending on the rotational speed of fan wheel 22 and other factors. At a fan speed of about 800 rpm, the peak frequency in some cases is about 630 hertz. At 1,000 rpm, the peak frequency may be about 800 hertz.

It appears that noise 26 is not generated by vibration of heater 24, vibration of fan wheel 22, or other PTAC components because noise 26 primarily occurs only when heater 24 is hot. Moreover, the heating elements closest to fan wheel 22 seem to have the greatest effect on the noise. It is speculated that the high pitch noise is due to vortex shedding generated in the tight space between fan wheel 22 and heater 24. Tests indicate that the heating elements closest to fan wheel 22, such as elements 24*a* and 24*b*, which are less than one fan diameter 50 away from fan wheel 22 have the greatest impact. The impact is less for elements spaced farther away, particularly if the heating element is more than one fan diameter 50 away (e.g., element 24*f*); however, heating elements even half a fan diameter away (e.g., element 24*b*) may have noticeably less impact.

One or more solutions implemented alone or in combination may reduce or eliminate tonal noise 26. Examples of some conceivably workable solutions include, but are not limited to, installing noise-abating flow disruptor 28 between heater 24 and fan wheel 22, lowering the height of heater 24 below that of heat exchanger 36, providing heater 24 with lower wattage elements near the top of heater 24 and higher wattage elements near the bottom, and horizontally or otherwise staggering the heating elements. In a currently preferred embodiment, PTAC system 10 includes flow disruptor 28, the top of heater 24 is lower than heat exchanger 36, and the lower wattage heating elements of heater 24 are near the top.

Figure 5:
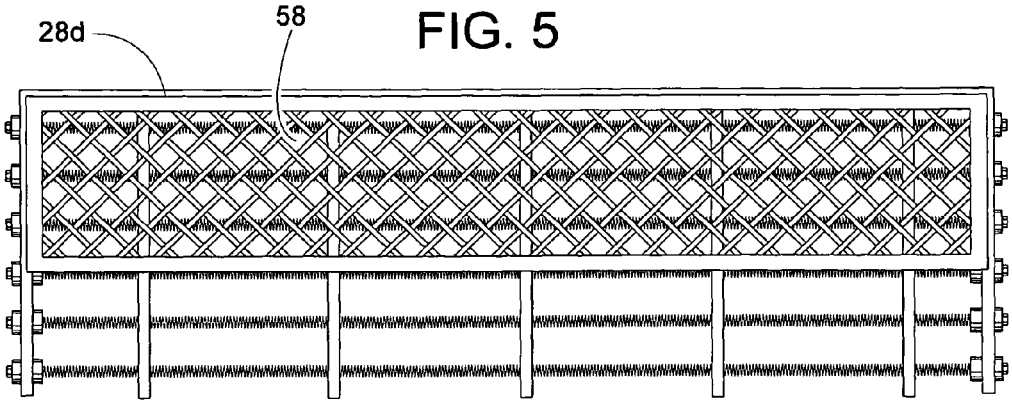
FIG. 5 is a front view of another embodiment of a noise-abating flow disruptor that can be used in the PTAC of FIG. 1.

In FIG. 1, flow disruptor 28 is schematically illustrated to represent various designs including, but not limited to, a perforated plate 28*a* (FIG. 2), a series of vertical bars 28*b* (FIG. 3), a series of horizontal bars 28*c* (FIG. 4), and a wire mesh screen 28*d* or expanded metal (FIG. 5). Flow disruptor 28 preferably has a plurality of fixed openings through which air 40 can flow. The openings can be of various shapes as indicated by openings 52, 54, 56 and 58, which are illustrated in FIGS. 2, 3, 4 and 5, respectively.

Figure 3:
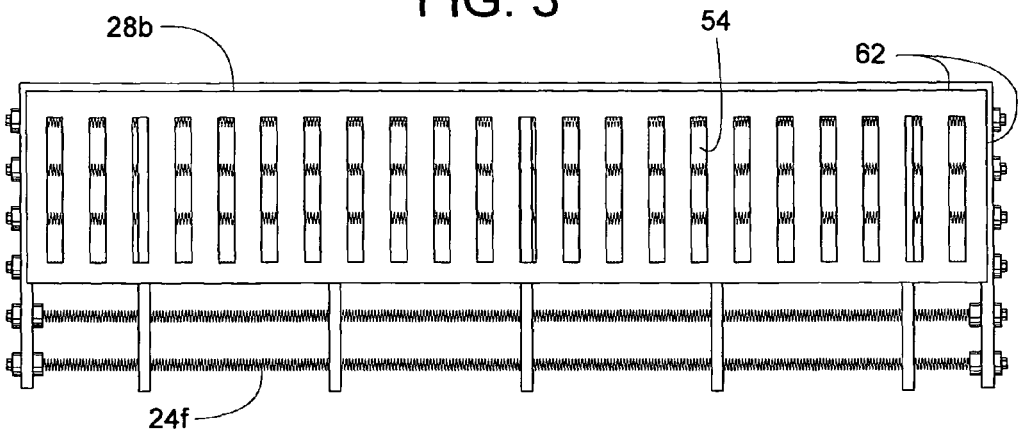
FIG. 3 is a front view of another embodiment of a noise-abating flow disruptor that can be used in the PTAC of FIG. 1.
Figure 4:
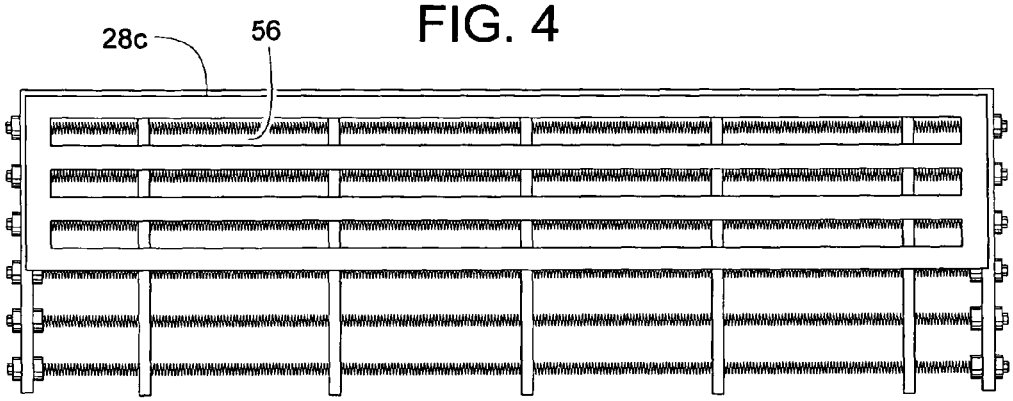
FIG. 4 is a front view of another embodiment of a noise-abating flow disruptor that can be used in the PTAC of FIG. 1.

Flow disruptor 28 has an outer perimeter, e.g., perimeter 60 of FIG. 2 or perimeter 62 of FIG. 3 such that the perimeter 60 or 62 surrounds an area that is mostly open to allow air 40 to pass. In some cases, flow disruptor 28*a*, for example, has a set of perforations whose total area comprises about 52% of the entire area within perimeter 60.

Flow disruptor 28 does not necessarily have to extend fully down to the bottom of heater 24 because the lower heating elements, such as elements 24*e* and 24*f*, may be sufficiently distant from fan wheel 22 that those elements do not cause a problem. Thus, in some cases, flow disruptor 28 provides more of an obstruction at the upper heating elements than at the lower ones.

Figure 6:
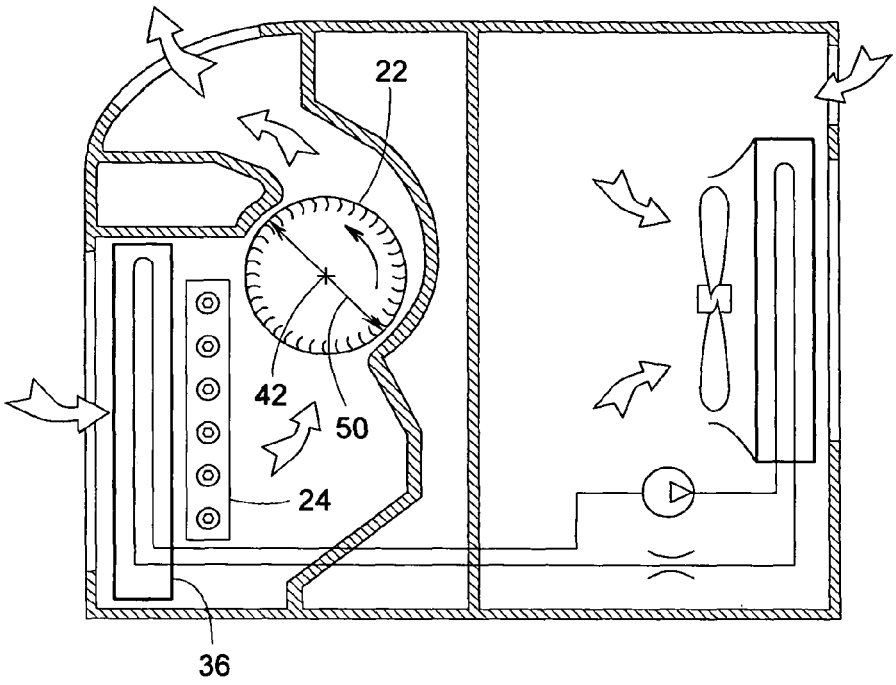
FIG. 6 is a cross-sectional side view similar to FIG. 1 but with the noise-abating flow disruptor omitted.

Ultimately, flow disruptor 28 preferably creates a sufficient airflow disruption such that PTAC system 10 operates more quietly with flow disruptor 28 than if flow disruptor 28 were omitted (FIG. 6). To measure the noise emanating from system 10, the noise can be sensed at one meter 64 from axis 42. With flow disruptor 28 and/or with other aforementioned ways for reducing noise 26, the sound or tonal noise 26 at a certain peak frequency between 500 and 1,500 hertz is no more than 5 decibels, and in some cases less than 2 decibels, louder when electric heater 24 is energized than when heater 24 is de-energized (i.e., with fan 22 running and the sound sensed at one meter from axis 42).

In one particular embodiment, the addition of noise-abating flow disruptor 28*a* reduced noise 26 about 12 db (as measured at one meter from axis 42) when fan wheel 22 was rotating at about 800 rpm. In this case, noise 26 occurred at a peak frequency of about 630 Hz. When the fan speed of this same unit was increased to 1,000 rpm, the addition of flow disruptor 28*a* reduced noise 26 about 7 db, wherein the peak frequency occurred at about 800 Hz.

To further minimize the tonal noise caused by the proximity of heater 24 relative to fan wheel 22, the two upper heating elements 24*a* and 24*b*, which are closest to fan wheel 22, are each only 0.5-kw heaters, while the rest of the heating elements 24*c-f* are 1-kw heaters. This not only minimizes the localized heating near fan wheel 22, the heating elements can be selectively energized for adjusting the heat output. Only heaters 24*e* and 24*f* are energized for 2-kw of heat, heaters 24*a*, 24*b*, 24*e* and 24*f* are energized for 3-kw, and all of the heating elements 24*a-f* are energized for 5-kw of heat.

Although placing the lower-wattage heating elements closest to fan wheel 22 may alone reduce the tonal noise to an acceptable level, better results may be achieved by also installing flow disruptor 28 such that flow disruptor 28 provides more of an airflow obstruction at lower-wattage element 24*a* than at the higher wattage element 24*f*.

In another embodiment, heaters 24*a*, 24*b*, 24*c*, 24*d*, 24*e* and 24*f* are 0.25-kw, 0.25-kw, 0.75-kw, 0.75-kw, 1.75-kw and 1.75-kw respectively. In this case, heaters 24*a-d* are energized for 2-kw of heat, heaters 24*e* and 24*f* are energized for 3.5-kw, and heaters 24*c-f* are energized for 5-kw. It should be appreciated by those of ordinary skill in the art that there are infinite combinations of the quantity of heating elements, their individual kilowatt ratings, and how they are selectively energized.

Figure 7:
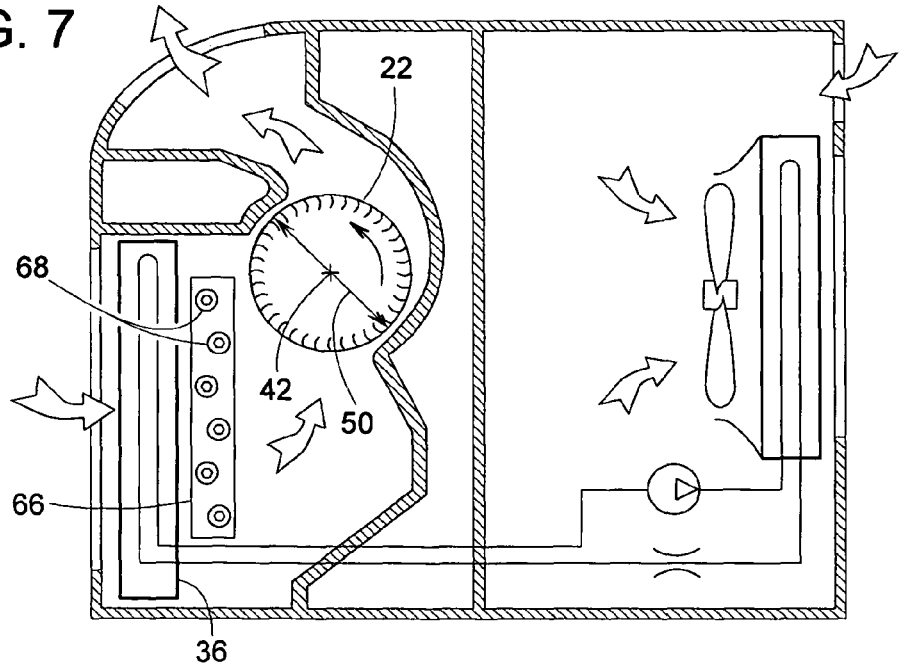
FIG. 7 is a cross-sectional side view similar to FIG. 1 but with a modified electric heater.
Figure 8:
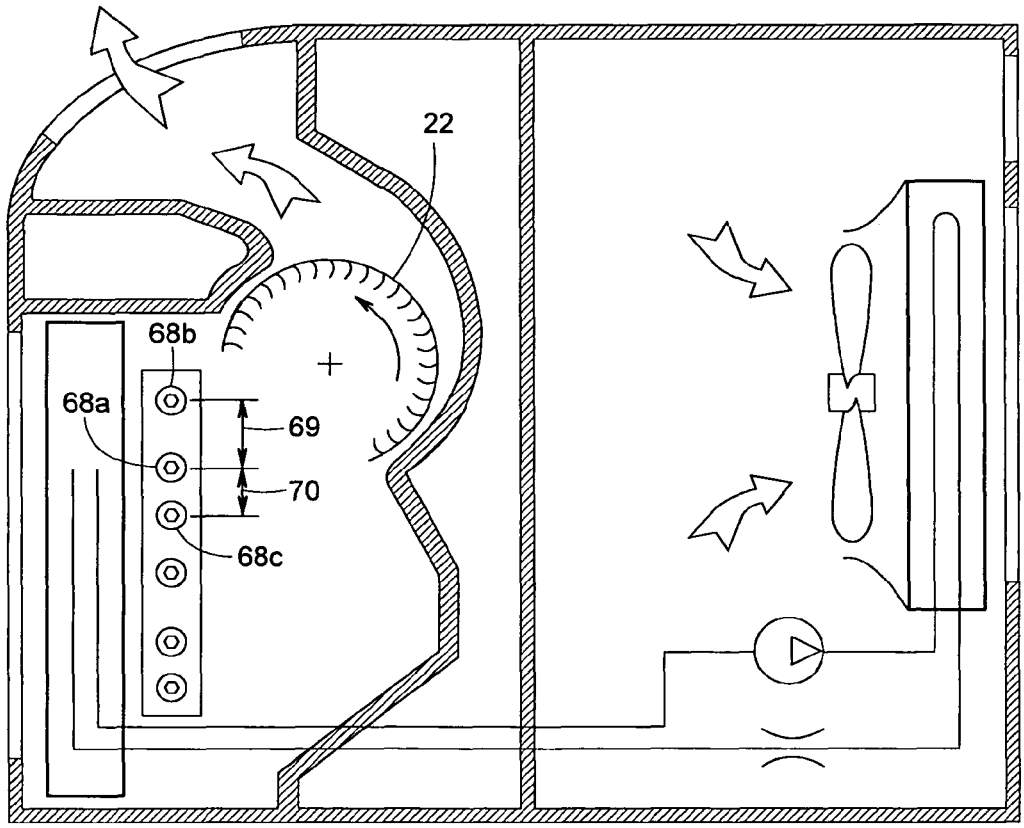
FIG. 8 is a cross-sectional side view similar to FIG. 1 but with a modified electric heater.

FIG. 7 illustrates yet another way that might reduce the tonal noise down to an acceptable level. In this example, electric heater 66 comprises a plurality of selectively energizable heating elements 68 that are horizontally staggered. The staggered arrangement places the uppermost heating element farther away from fan wheel 22 than it might be otherwise. Moreover, the positions of the heating elements 68 could perhaps be such that the noise or vortex shedding at each heating element 68 may help cancel each other. Although the heating elements are shown in a horizontally staggered and symmetrical arrangement, other arrangements, such as an asymmetrical staggered arrangement, are contemplated where the heating elements 68 are located so that noise generated by any particular heating element 68 either interferes with or cancels noise generated by one or more of the other heating elements 68. An asymmetrical staggered arrangement can occur by horizontally staggering the heater elements at different distances from an arbitrary vertical line, or, as shown in FIG. 8, can occur by staggering heating elements 68 such that at least one heating element 68*a* is displaced from a first adjacent heating element 68*b* by a first distance 69 and is displaced from a second adjacent heating element 68*c* by a second distance 20 where the first distance differs from the second distance. Asymmetrical staggering can also occur through the use of a combination of horizontal and vertical staggering as described above.

Although the invention is described with respect to a preferred embodiment, modifications thereto will be apparent to those of ordinary skill in the art. Therefore, the scope of the invention is to be determined by reference to the following claims.

The invention claimed is:

1. A refrigerant system, comprising:

a housing;

a refrigerant heat exchanger disposed within the housing;

a fan wheel rotating about an axis, thereby forcing air through the housing;

an electric heater upstream of the fan wheel and downstream of the refrigerant heat exchanger, wherein the electric heater can be selectively energized and de-energized; and a sound at a certain peak frequency between 500 and 1,500 hertz emanating from the refrigerant system, wherein the sound at one meter from the axis is no more than 5 decibels louder when the electric heater is energized than when the electric heater is de-energized.

2. The refrigerant system of claim 1, further comprising a noise-abating flow disruptor interposed between the fan wheel and the electric heater, wherein the noise-abating flow disruptor defines a plurality of fixed openings through which the air can flow.

3. The refrigerant system of claim 2, further comprising a noise-abating flow disruptor interposed between the fan wheel and the electric heater, the electric heater comprises a plurality of heating elements, and the noise-abating flow disruptor provides a greater airflow obstruction at some of the plurality of heating elements than others.

4. The refrigerant system of claim 3, wherein the electric heater comprises a plurality of selectively energizable heating elements including a higher-wattage element and a lower-wattage element, and the fan wheel is closer to the lower-wattage element than the higher-wattage element.

5. The refrigerant system of claim 1, further comprising a noise-abating flow disruptor interposed between the fan wheel and the electric heater, the electric heater comprises a plurality of heating elements, and the noise-abating flow disruptor provides a greater airflow obstruction at some of the plurality of heating elements than others.

6. The refrigerant system of claim 1, wherein the electric heater comprises a plurality of selectively energizable heating elements including a higher-wattage element and a lower-wattage element, and the fan wheel is closer to the lower-wattage element than the higher-wattage element.

7. The refrigerant system of claim 6, further comprising a noise-abating flow disruptor interposed between the fan wheel and the electric heater, wherein the noise-abating flow disruptor provides more of an airflow obstruction at the lower-wattage element than at the higher wattage element.

8. The refrigerant system of claim 1, wherein: the fan wheel has an outer diameter; the electric heater comprises a plurality of heating elements including an upper heating element spaced a first distance from the fan wheel and a lower heating element spaced a second distance from the fan wheel; the first distance is less than the outer diameter; and the second distance is greater than half the outer diameter.

9. The refrigerant system of claim 1, wherein the refrigerant heat exchanger is taller than the electric heater.

10. A refrigerant system, comprising:

a housing defining an inlet and an outlet;

a fan wheel disposed within the housing and being rotatable about an axis to force air through the housing;

a refrigerant heat exchanger disposed within the housing;

an electric heater disposed within the housing, wherein the electric heater is downstream of the refrigerant heat exchanger and upstream of the fan wheel; a noise-abating flow disruptor located downstream of the electric heater and upstream of the fan wheel, the noise-abating flow disruptor comprising an outer periphery surrounding an area having a plurality of openings through which air can flow, the air passes sequentially through the electric heater, through the noise-abating flow disruptor and across the fan wheel, and a sound emanating from the refrigerant system, the sound at one meter from the axis is no more than 5 decibels louder when the electric heater is energized than when the electric heater is de-energized.

11. The refrigerant system of claim 10, wherein the electric heater comprises a plurality of heating elements, and the noise-abating flow disruptor provides more of an obstruction at some of the plurality of heating elements than others.

12. The refrigerant system of claim 10, wherein the electric heater comprises a plurality of selectively energizable heating elements including a higher-wattage element and a lower-wattage element; and wherein the noise-abating flow disruptor provides more of an airflow obstruction at the lower-wattage element than at the higher wattage element.

13. The refrigerant system of claim 10, wherein the noise-abating flow disruptor has an outer periphery surrounding an area that is mostly open to allow the air to pass.

14. The refrigerant system of claim 10, wherein the electric heater comprises a plurality of heating elements, and the noise-abating flow disruptor provides more of an obstruction at some of the plurality of heating elements than others.

15. The refrigerant system of claim 10, wherein the electric heater comprises a plurality of selectively energizable heating elements including a higher-wattage element and a lower-wattage element.

16. The refrigerant system of claim 15, wherein the fan wheel is closer to the lower-wattage element than the higher-wattage element.

17. The refrigerant system of claim 15, wherein the noise-abating flow disruptor provides more of an airflow obstruction at the lower-wattage element than at the higher wattage element.

18. The refrigerant system of claim 10, wherein: the fan wheel has an outer diameter; the electric heater comprises a plurality of heating elements including a first heating element spaced a first distance from the fan wheel and a second heating element spaced a second distance from the fan wheel; the first distance is less than the outer diameter; and the second distance is greater than half the outer diameter.

19. The refrigerant system of claim 10, wherein the refrigerant heat exchanger is taller than the electric heater.

20. A refrigerant system, comprising:

a housing;

a refrigerant heat exchanger disposed within the housing;

an electric heater disposed within the housing; and a fan wheel disposed within the housing for forcing air across the refrigerant heat exchanger and the electric heater; wherein the electric heater comprises a plurality of selectively energizable beating elements including a higher-wattage element and a lower-wattage element, and the fan wheel is closer to lower-wattage element than the higher-wattage element.

21. The refrigerant system of claim 20, wherein the lower-wattage element is above the higher-wattage element.

22. The refrigerant system of claim 20, further comprising a noise-abating flow disruptor interposed between the fan wheel and the electric heater, wherein the noise-abating flow disruptor defines a plurality of fixed openings through which the air can flow.

23. The refrigerant system of claim 20, further comprising a noise-abating flow disruptor upstream of the fan wheel and downstream of the electric heater, wherein the noise-abating flow disruptor has an outer periphery surrounding an area that is mostly open to allow the air to pass.

24. The refrigerant system of claim 20, further comprising a noise-abating flow disruptor upstream of the fan wheel and downstream of the electric heater, wherein the noise-abating flow disruptor is closer to the lower-wattage element than the higher- wattage element

25. The refrigerant system of claim 20, further comprising a noise-abating flow disruptor upstream of the fan wheel and downstream of the electric heater, wherein the noise-abating flow disruptor provides more of an airflow obstruction at the lower- wattage element than at the higher wattage element.

26. The refrigerant system of claim 25, wherein: the fan wheel is rotatable about an axis: the fan wheel has an outer diameter; the lower-wattage element is spaced a first distance from the fan wheel; the higher-wattage element spaced a second distance from the fan wheel; the first distance is less than the outer diameter; and the second distance is greater than half the outer diameter.

* * * * *

UNITED STATES PATENT AND TRADEMARK OFFICE

CERTIFICATE OF CORRECTION

PATENT NO. : 7,802,615 B2
APPLICATION NO. : 11/356283
DATED : September 28, 2010
INVENTOR(S) : Ferdy Martinus et al.

It is certified that error appears in the above-identified patent and that said Letters Patent is hereby corrected as shown below:

IN THE CLAIMS:

Claim 20, Column 8, Line 26, "beating element" should read --heating element--.

Claim 25, Column 8, Line 51, "lower- wattage element" should read --lower-wattage element--.

Signed and Sealed this

Twenty-first Day of December, 2010

David J. Kappos

David J. Kappos
*Director of the United States Patent and Trademark Office*